US007441878B2

(12) United States Patent
Iijima

(10) Patent No.: US 7,441,878 B2
(45) Date of Patent: Oct. 28, 2008

(54) INK JET RECORDING HEAD INCLUDING TEMPERATURE ADJUSTMENT HEATER

(75) Inventor: Yasushi Iijima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 352 days.

(21) Appl. No.: 11/348,353

(22) Filed: Feb. 7, 2006

(65) Prior Publication Data

US 2006/0181578 A1 Aug. 17, 2006

(30) Foreign Application Priority Data

Feb. 17, 2005 (JP) ..... 2005-040590

(51) Int. Cl.
*B41J 2/05* (2006.01)

(52) U.S. Cl. ..... 347/62; 347/43

(58) Field of Classification Search ..... 347/14, 347/17, 20, 40, 43, 44, 56–65, 67
See application file for complete search history.

(56) References Cited

U.S. PATENT DOCUMENTS 6,527,367 B2 * 3/2003 Yabe ..... 347/43
6,591,500 B1 7/2003 Suzuki et al. ..... 29/890.1
6,733,117 B2 5/2004 Tajima et al. ..... 347/87
6,799,841 B2 10/2004 Iri et al. ..... 347/85
2006/0181571 A1 8/2006 Iijima ..... 347/40

FOREIGN PATENT DOCUMENTS

JP 7-52387 2/1995

* cited by examiner

*Primary Examiner*—Juanita D Stephens
(74) *Attorney, Agent, or Firm*—Fitzpatrick, Cella, Harper & Scinto

(57) ABSTRACT

An ink jet recording head can discharge a droplet of differently colored ink, so that the volume of the ink discharged is efficiently stabilized, without the apparatus size and the manufacturing costs being increased. Three ink supply ports are formed in a recording element board, and one nozzle array is arranged along one side of each ink supply port. The discharge portions for cyan ink and magenta ink, which have high visibility, are located on opposite sides of the recording element board, and the discharge portion for yellow ink, which has low visibility, is located in the center of the recording element board. Further, in the cyan ink and magenta ink discharge portions, sub heaters for temperature adjustment are arranged, relative to the ink supply ports, along the same sides as the nozzle arrays.

3 Claims, 7 Drawing Sheets

INK JET RECORDING HEAD INCLUDING TEMPERATURE ADJUSTMENT HEATER

BACKGROUND OF THE INVENTION

1. Field of the Invention

The present invention relates to an ink jet recording head for discharging ink to perform recording, and a recording apparatus provided with this recording head.

2. Related Background Art

A recording apparatus that includes an ink jet recording head on the basis of supplied recording information prints images on a recording medium (a recording material), such as paper, a plastic sheet or an OHP (Overhead Projector) sheet. In the specifications for the present invention, "images" are expressions used not only for things such as characters, symbols and drawings that provide individual definitions, but also for things such as patterns and full colors that provide no definitions. "Recording" and "image forming" represent general operations for forming these images.

The ink jet recording apparatus heats or vibrates ink supplied to ink jet recording head, and discharges the ink toward a recording medium, such as a recording sheet, to perform image recording. Ink droplets, discharged by the ink jet recording head and attached to the recording medium, are spread on the recording medium, and form dots. Then, on the recording medium, an image is form as a set of dots. The area covered by a single dot is greatly dependant on the size of ink droplet, i.e., on the volumeof the ink discharged. Therefore, controlling the volume (amount) of ink discharge is very important to the process of forming high-resolution images using the ink jet method.

The volume of the ink discharged is acutely affected by the temperature of the ink and the temperature at the recording head, and varies as these temperatures change. Therefore, management of the temperature at the ink jet recording head and the temperature of the ink are vitally important, especially in a low temperature environment wherein the viscosity of the ink is increased and viscous resistance (drag) in the ink discharge nozzles (hereinafter referred to as "nozzles") of the ink jet recording head is increased, which drastically reduces the volume of ink that is discharged.

Therefore, a structure wherein a heat generation device (hereinafter referred to as a "temperature adjustment heater" or a "sub heater"), for heat insulation, is provided inside an ink jet recording head is disclosed in Japanese Patent Laid-Open Publication No. Hei 7-52387. According to the ink jet recording head disclosed in this publication, a sub heater is driven in a low temperature environment and raises the temperatures both of the ink and at the ink jet recording head, so as to stabilize the volume of ink discharged.

Recently, in order to provide high-quality recording, such as is required for printing photographs, using an ink jet recording apparatus, the trend is to minimize, to the extent possible, the sizes of the ink droplets that are discharged by an ink jet recording head. For such an ink jet recording head, which discharges minute droplets, since the openings of the discharge ports at their nozzle ends tend to be reduced, and viscous drag in the nozzles tends to be increased, the volume of ink discharged is sharply reduced within a short period of time, especially when the temperature is decreased. In order to provide the above-described heat insulation control at a high response speed and to stabilize the volume of the ink discharged, the provision of multiple sub heaters is effective. However, according to this method, the area of a substrate on which the sub heaters are mounted would be increased, and accordingly, the size of the entire ink jet recording head would be greater. Further, the manufacturing costs would rise.

SUMMARY OF THE INVENTION

To resolve these problems, one objective of the present invention is to provide an ink jet recording head that includes multiple nozzle arrays that can discharge inks of different colors, wherein the volume of the ink discharged can be efficiently stabilized without causing the size of the head to be increased or the manufacturing costs to rise. Another objective of the present invention is to provide a recording apparatus provided with this ink jet recording head.

To achieve these objectives, an ink jet recording head according to the present invention comprises:

a first nozzle array for discharging predetermined ink;

a second nozzle array for discharging ink that has a higher visibility than ink discharged by the first nozzle array has; and an element substrate, including a first heat-generating resistor element array and a second heat-generating resistor element array, which correspond to the first nozzle array and the second nozzle array, and a temperature adjustment heater, wherein a distance between the temperature adjustment heater and the second heat-generating resistor element array is shorter than a distance between the temperature adjustment heater and the first heat-generating resistor element array.

In the specification, of those inks having a plurality of colors that are discharged by the ink jet recording head, an "ink having higher visibility" is an ink for which the color is more easily distinguished than are all the other colors.

According to the present invention, heat insulation can be provided, at a high response speed, for all the nozzle arrays that discharge ink having a high visibility and for all areas in the vicinities of the nozzle arrays. Further, without especially increasing the number of sub heaters, a drastic reduction in the volume of ink discharged, due to increased ink viscosity, can be avoided and stable, high-quality recording is enabled. In addition, since the warm-up time required before a recording operation is begun can be reduced and the first printing can be speedily performed, in general, the recording speed is improved. Further, ink jet recording head size increases and corresponding manufacturing cost rises can also be avoided.

DETAILED DESCRIPTION OF THE PREFERRED EMBODIMENTS

Figure 1A:
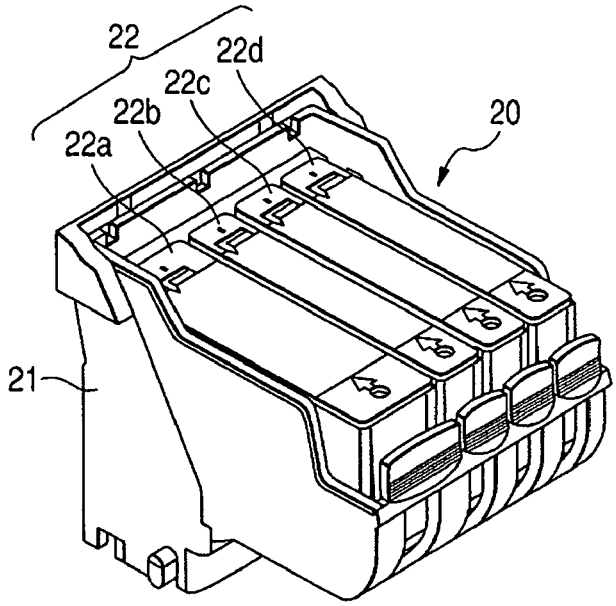
FIG. 1A is a perspective view, according to a first embodiment of the present invention, of the structure of an ink jet recording head cartridge that includes an ink jet recording head.
Figure 1B:
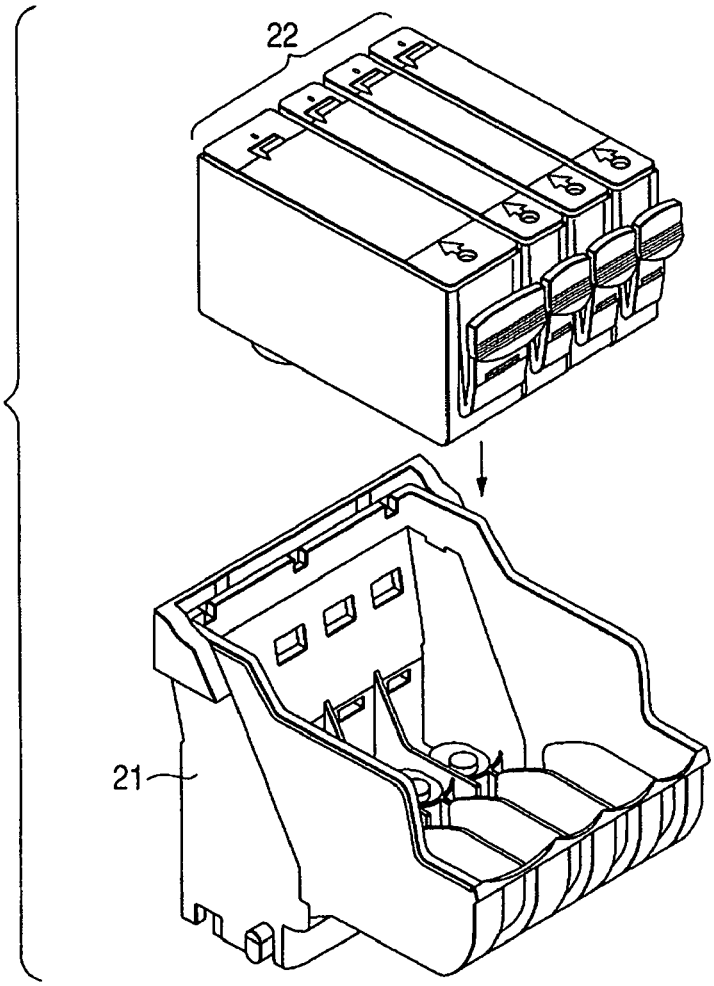
FIG. 1B is an exploded perspective view of the ink jet recording head cartridge.

The preferred embodiments of the present invention will now be described while referring to the accompanying drawings.

First Embodiment

FIGS. 1 to 6 are diagrams for explaining the structure of an ink jet recording head according to a first embodiment of the present invention. As shown in FIGS. 1A and 1B, an ink jet recording head 21 for this embodiment is a constituent of an ink jet recording head cartridge 20. The ink jet recording head cartridge 20 includes the ink jet recording head 21, and an ink tank 22, detachably provided to the ink jet recording head 21. In accordance with recording information transmitted from a controller 1 (see FIG. 6), the ink jet recording head 21 discharges, through ink discharge ports 15 (see FIG. 4), ink supplied from the ink tank 22.

The ink jet recording head cartridge 20 is positioned by positioning means (not shown), relative to a carriage 2 (see FIG. 6) mounted on the main body of an ink jet recording apparatus, and is electrically connected, at an electrical contact, to the carriage 2, where it is detachably supported. The ink tank 22 in this embodiment includes an ink tank 22*a* for black ink, an ink tank 22*b* for cyan ink, an ink tank 22*c* for magenta ink and an ink tank 22*d* for yellow ink. These ink tanks 22*a* to 22*d* are independently detachable from the portion (see FIG. 3) of the ink jet recording head 21 whereat rubber seals 402 are provided, and can be individually exchanged.

The ink jet recording head 21 has a plurality of ink flow paths (not shown), and electrothermal transducing elements 50 (recording elements; see FIGS. 4 and 6), which generate thermal energy and induce the film boiling of ink, are provided along the individual ink flow paths. In accordance with image information that is supplied as electrical signals from the controller 1, the ink jet recording head 21 selectively drives the electrothermal transducing elements 50, which induce film boiling through heat generation and discharge ink, to perform image recording. The ink jet recording head 21 is a so-called side-shooter type ink jet recording head wherein ink droplets are discharged from the ink discharge ports 15 that penetrate the board faces of the substrate that forms the ink flow paths.

Figure 2:
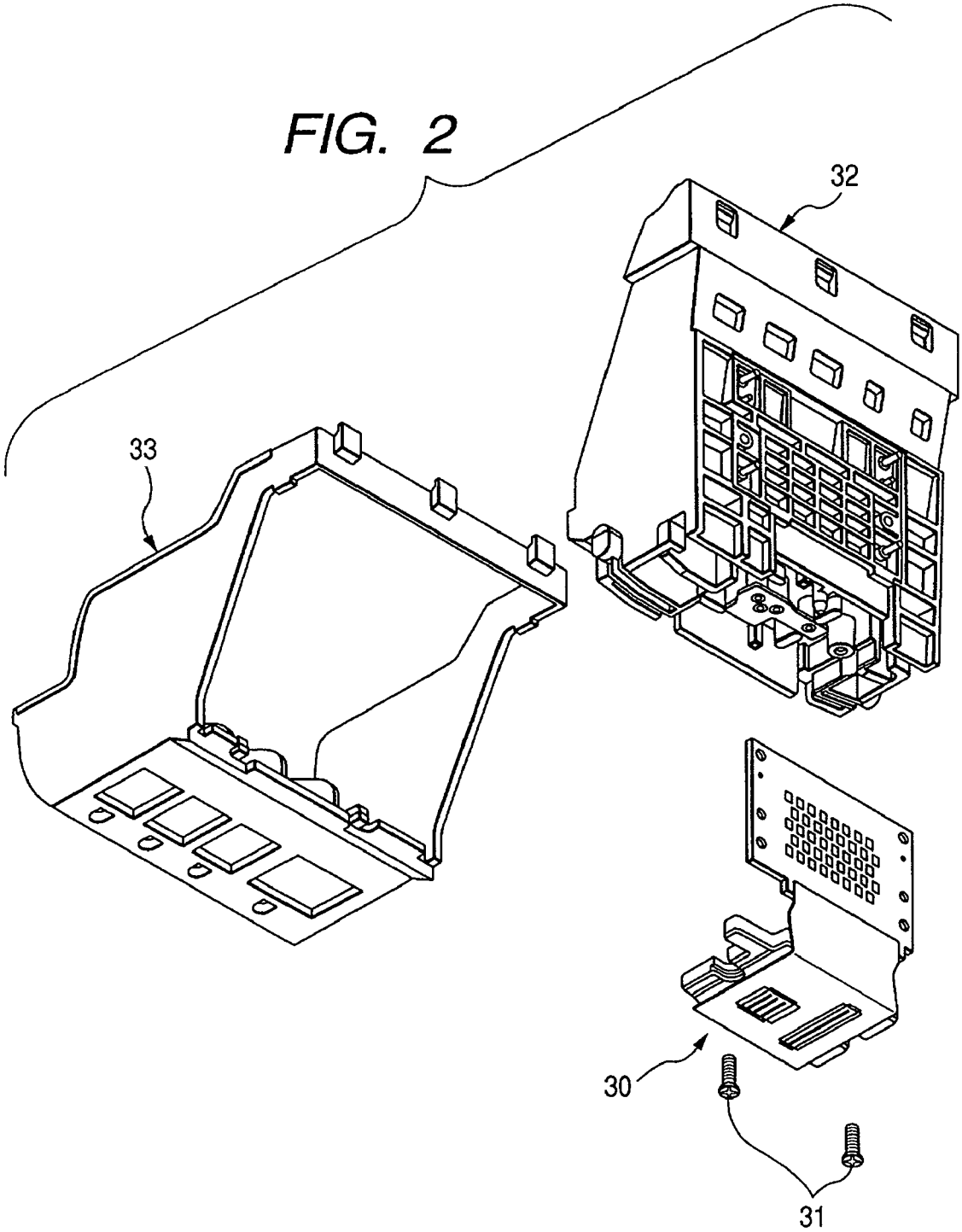
FIG. 2 is an exploded perspective view of the structure of the ink jet recording head shown in FIGS. 1A and 1B.

Further, as shown in the exploded perspective view in FIG. 2, the ink jet recording head 21 is also constituted by a recording element unit 30, an ink supply unit 32 and a tank holder 33. Furthermore, as shown in the exploded perspective view in FIG. 3, the recording element unit 30 is constituted by a first recording element board 410 for black ink, a second recording element board 409 for colored ink, a first plate (a first support member) 406, an electrical wiring tape (a flexible wiring board) 412, an electrical contact board 411 and a second plate (a second support member) 408.

The ink supply unit 32 is constituted by an ink supply member 403, a flow path formation member 404, a rubber joint (a sealing member) 405, a filter 401 and the rubber seals 402.

A further detailed explanation will be given for the second recording element board 409 for colored ink, which is the constituent of the ink jet recording head 21 that especially provides the main feature of the invention.

Figure 4:
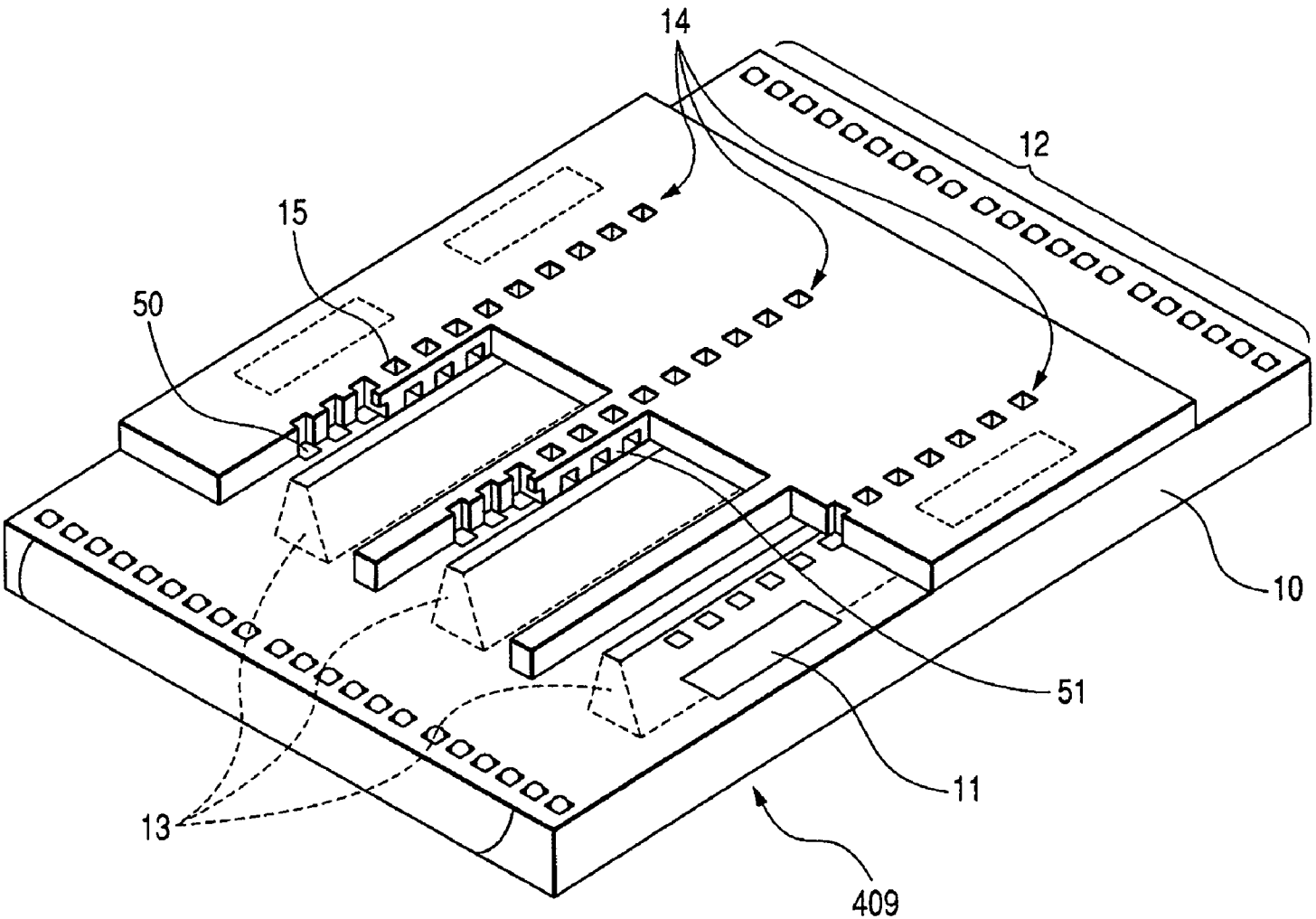
FIG. 4 is a perspective view of a second recording element substrate for the ink jet recording head shown in FIG. 3.

FIG. 4 is a perspective view of the second recording element board 409 for colored ink, with one part thereof disassembled for explaining the structure thereof. The second recording element board 409 for colored ink is a recording element board, for discharging ink in three colors, that is a 0.5 to 1 mm thick silicon (Si) substrate 10. A plurality of the electrothermal transducing elements 50, for discharging ink, a plurality of sub heaters (temperature adjustment heaters) 11, for providing insulating heat for the Si substrate 10 itself, and electrical wiring, for supplying power to the individual electrothermal transducing elements 50, are formed on one side of the Si substrate 10 using a well known film deposition technique.

Further, in consonance with the electrothermal transducing elements 50, multiple ink flow paths and a plurality of ink discharge ports 15 are formed using well known photolithography. In addition, ink supply ports 13, for supplying ink to the plural ink flow paths, are opened to the opposite face (the reverse face) of the Si substrate 10. The three ink supply ports 13 are arranged in parallel, and on one side of each ink supply port 13, an electrothermal transducing element 50 and ink discharge ports 15 are aligned as arrays in the longitudinal direction of the ink supply port 13. However, for all the ink supply ports 13, the array of the electrothermal transducing elements 50 and the array of ink discharge ports 15 (nozzle array 14) need not be located on the same side.

Figure 3:
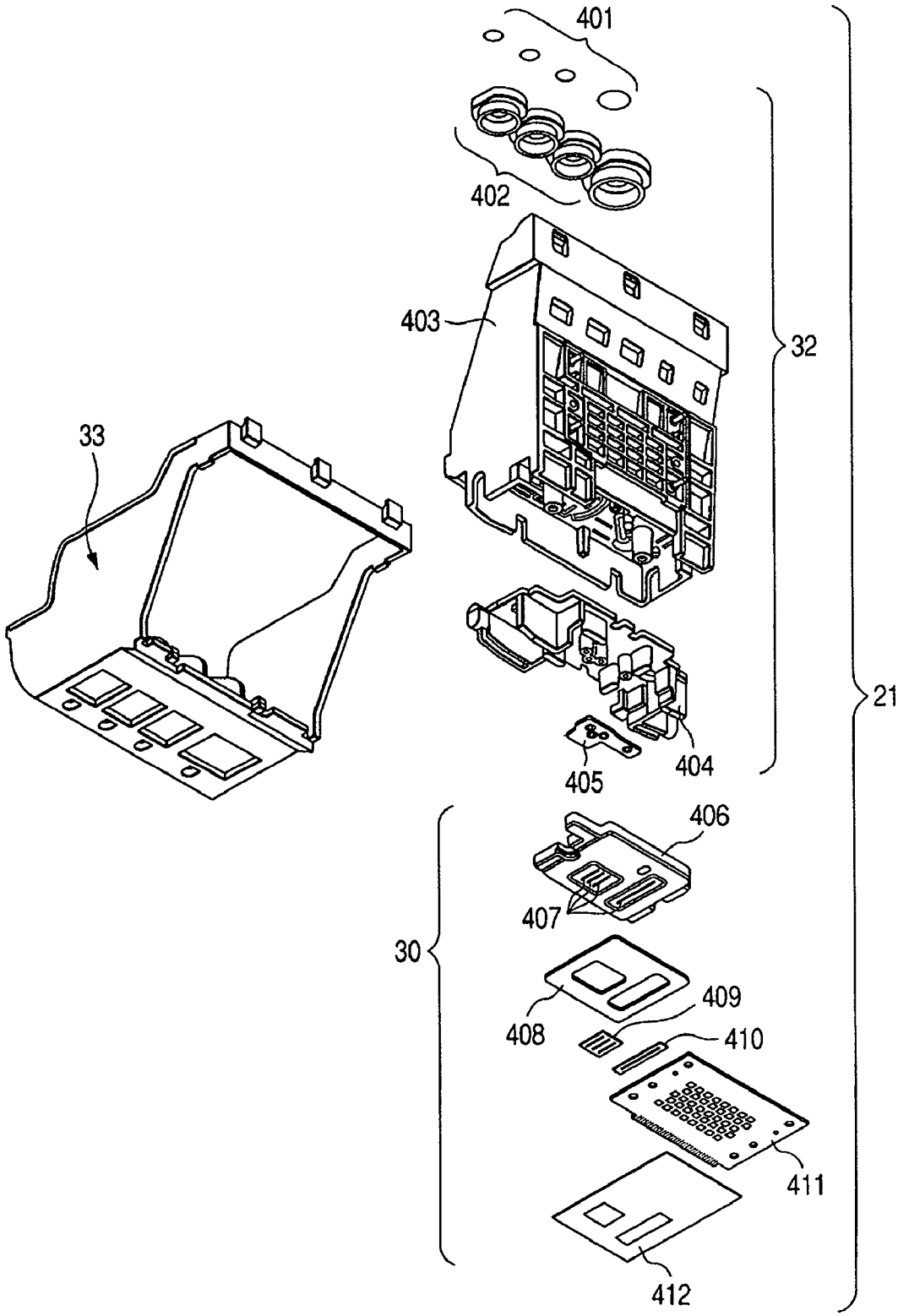
FIG. 3 is a further exploded perspective view of the ink jet recording head shown in FIG. 2.

As shown in FIG. 3, the second recording element board 409 is bondingly fixed to the first plate 406, and the ink supply ports 13 are located at this fixed portion. Further, the second plate 408, which has an opening, is securely bonded to the first plate 406, and through the opening in the second plate 408, the electrical wiring tape 412 is electrically connected to the second recording element board 409. The electrical wiring tape 412 is used to transmit electrical signals for the discharge of ink from the controller 1 (see FIG. 6) to the second recording element board 409. Although not shown in the drawings, the electrical wiring tape 412 includes electrical wiring, which is consonant with the electrical wiring for the second recording element board 409, and an external signal input terminal, which is positioned in this electrical wiring so that it can receive electrical signals transmitted by the controller 1. The external signal input terminal is positioned and fixed to the side near the rear face of the ink supply member 403.

The ink supply ports 13 are formed using a method such as anisotropic etching, which employs the crystal orientation of Si, or sand blasting. On both sides, with each ink supply port 13 in between, the arrays -of the electrothermal transducing elements 50 are arranged in zigzag manner, as a whole. A set consisting of an array of the plural electrothermal transducing elements 50 and an array of the plural ink discharge ports 15 is called a "nozzle array 14".

The electrothermal transducing elements 50, the sub heaters 11 and electrical wiring, such as Al, for supplying power to these components are formed using a well known film deposition technique. Further, electrodes 12 for supplying power to the electrical wiring are arranged on both sides of the second recording element board 409, i.e., arrays of electrodes 12 are arranged substantially perpendicular to the arrays of the electrothermal transducing elements 50, and outside both ends of the arrays of the electrothermal transducing elements 50. Bumps, such as Au bumps, are formed on the electrodes 12 using the thermal ultrasonic soldering method. Further, in order to form ink flow paths consonant with the electrothermal transducing elements 50, ink flow path walls 51 and discharge ports 15 composed of a resin material are formed on the Si substrate 10 using the well known photolithography, so that the nozzle arrays 14 are provided. Thus, the ink discharge ports 15 are arranged for the individual flow paths, facing the electrothermal transducing elements 50. With this arrangement, ink supplied through the ink supply ports 13 to the ink flow paths is discharged from the ink discharge ports 15 by pressure imposed by bubbles that are generated by the heat produced by the electrothermal transducing elements 50.

The first recording element board 410 for black ink is structured in the same manner as for the second recording element board 409 for colored ink. Since ink of only one color (black ink) is supplied for the first element board 410, only one ink supply port 13 is formed, and on one side of the ink supply port 13, the electrothermal transducing elements 50 and the ink discharge ports 15 are aligned as arrays in the longitudinal direction of the ink supply port 13.

Figure 5:
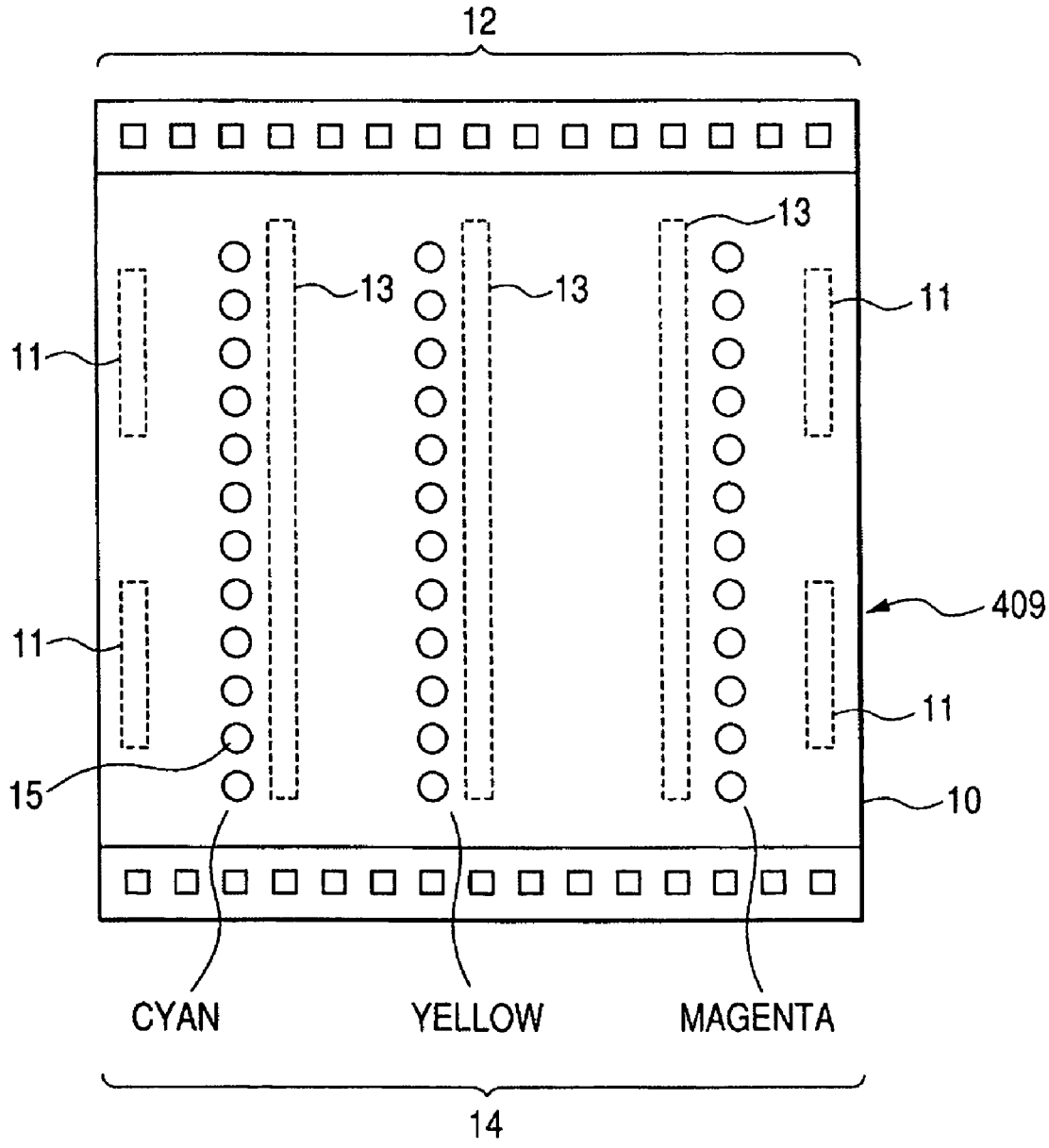
FIG. 5 is a schematic plan view of the structure of the second recording element substrate shown in FIG. 4.

A more detailed explanation will be given for the second recording element board 409, for colored ink, according to this embodiment, especially for the relationship between the nozzle arrays 14 and the sub heaters 11. FIG. 5 is a plan view of explaining the relationship between the nozzle arrays 14 and the sub heaters 11 of the second recording element board 409 for colored ink. The three ink supply ports 13 for colored ink, i.e., cyan, magenta and yellow inks, are formed in parallel in the second recording element board 409. And on one side of each ink supply port 13, the electrothermal transducing elements 50 and the ink discharge ports 15 are positioned as arrays in the longitudinal direction of the ink supply port 13. Specifically, in the cyan and yellow ink discharge portions, one nozzle array 14 is located to the left of the ink supply port 13, while in the magenta ink discharge portion, one nozzle array 14 is located to the right of the ink supply port 13.

In the recording element board 409 for colored ink in this embodiment, the nozzle arrays 14 for discharging cyan ink, magenta ink and yellow ink are formed, one at a time, from one side to the other. Each nozzle array 14 is located along one side of an ink supply port 13.

As described above, in the cyan ink discharge portion and the magenta ink discharge portion located on both sides of the second recording element board 409, the nozzle arrays 14 are positioned outside the ink supply port 13 (close to the outer edge of the second recording element board 409). The yellow ink discharge portion is located in the center of the second recording element board 409, and the nozzle array 14 may be arranged on either side of the ink supply port 13. The individual ink discharge ports 15 have the same diameter, and an appropriate volume of a discharged droplet is 1 to 10 pl. In this embodiment, 5 pl is employed.

For the ink flow paths wherein the small-diameter ink discharge ports 15, for discharging a small volume of ink, are formed in order to perform high quality recording, when viscous drag in the nozzles and the viscosity of ink concurrently increase, the volume of the ink discharged is greatly and sharply reduced. Therefore, at a low temperature, the temperature at the nozzle arrays 14 and in that vicinity should be quickly raised to reduce ink viscosity, so that the viscous drag in the nozzles can be reduced and the volume of the ink discharged can be stabilized. When a rise in temperature is immediately performed in a low temperature environment, not only can the image quality be increased by stabilizing the volume of the ink discharged, but also, the warm-up time can be shortened and the first printing (the first image forming performed following the beginning of the recording operation) can be quickly started, and in general, the recording speed can be increased.

The ink supply ports 13 are formed by opening the thermal conductive Si substrate 10, and this interferes with heat transmission. Therefore, when the sub heaters 11 are located on the side opposite the nozzle arrays 14, with the ink supply ports 13 in between, the effects on heat insulation are pronounced, and there is a time loss until the temperature at the nozzle arrays 14 rises.

Thus, in this embodiment, in the cyan ink discharge portion and the magenta ink discharge portion, the sub heaters 11 are located on both sides (the outer edges) of the second recording element board 409 where the individual nozzles 14 are arranged. Specifically, the nozzle arrays 14 and the sub heaters 11 are positioned on the same side relative to the ink supply ports 13. In this manner, when the temperature drops, the sub heaters 11 are activated to quickly raise the temperature at the nozzle arrays 14 for cyan ink and magenta ink, and the vicinities thereof, so that the viscosity of the ink is reduced, the viscous drag in the nozzles is lowered, and the volume of the ink discharged ink is stabilized. Furthermore, in this case, since wiring can be comparatively easily led along the sides of the second recording element board 409, an efficient layout can be easily provided for the electrical wiring for connection to the sub heaters 11.

In this embodiment, the sub heaters 11 are arranged near the nozzle array 14 for cyan ink and the nozzle array 14 for magenta ink, and not near the nozzle array 14 for yellow ink. This is because yellow has a lower visibility than has cyan and magenta, and when the volume of yellow ink discharged is reduced, it is not so readily apparent that deterioration of an image has occurred. That is, in this embodiment, sub heaters 11 are not provided in the center of the second recording element board 409 where an efficient electrical wiring layout can not easily be provided, and design and manufacturing complexities are thus avoided. In this embodiment, however, it should be noted that the portion for the discharge of less visible ink, i.e., ink (yellow ink, in this case) for which, when the volume discharged is reduced by a drop in temperature, it is not so readily apparent that deterioration of an image has occurred, is located in the center of the second recording element board 409.

With the above-described simple structure, effects are obtained whereby a drop in temperature can be efficiently countered at the nozzle arrays for ink (cyan ink and magenta ink) having high visibility and the vicinities thereof, and a reduction in the volume discharged can be prevented. Other effects can also be obtained in that when sub heaters 11 are not provided near the nozzle arrays for less visible ink (yellow ink), for which a small reduction in the volume of ink discharged is permissible, the structure is simplified, as are the design and manufacturing processes.

Figure 6:
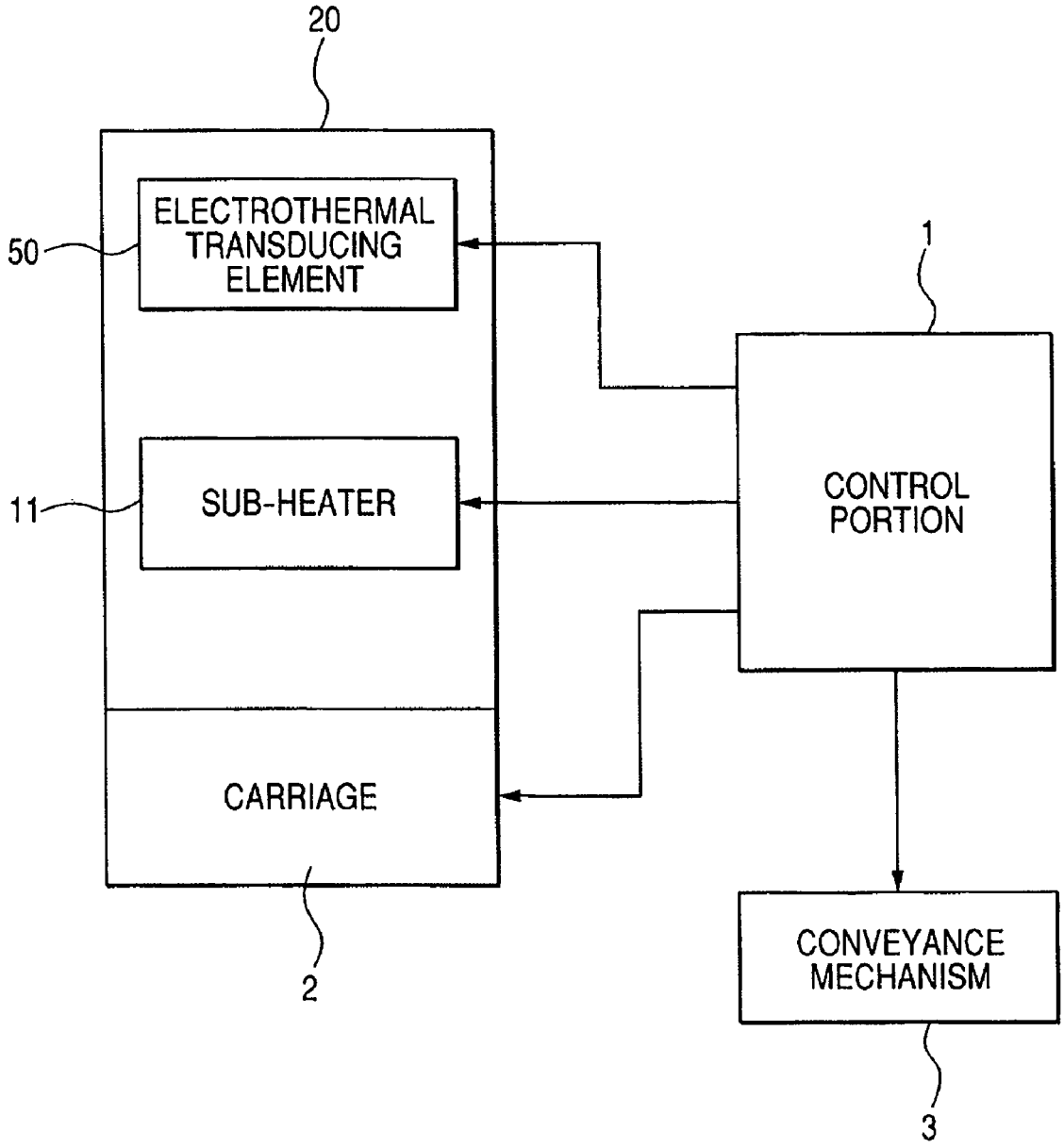
FIG. 6 is a schematic block diagram showing the basic configuration of a recording apparatus that includes an ink jet recording head according to the present invention.

FIG. 6 is a schematic diagram showing a recording apparatus including the ink jet recording head 21. In the recording operation performed by the recording apparatus, the control portion 1 drives the carriage 2, and moves it and the ink jet recording cartridge 20, which includes the ink jet recording head 21, so they pass across a recording medium (not shown) that is stopped at a recording start position (main scanning). Then, at an appropriate timing, an electrical drive signal, based on information for an image to be formed, is selectively supplied to a predetermined electrothermal transducing element 50, and ink is discharged onto a recording medium to perform image forming for one line.

When the image forming for one line has been completed, the control portion 1 drives a conveyance mechanism 3 that moves the recording medium a pitch equivalent to one line (sub-scanning). By alternately performing the main scanning and sub-scanning, an image is formed on the entire recording medium. And when a drop in the temperature of the ink jet recording head 21 is detected by a sensor (not shown), for example, the control portion 1 immediately drives the sub heaters 11 to raise the temperature. As described above, the temperature is quickly raised, especially at the nozzle arrays 14 that discharge a small volume of ink and the vicinities thereof. As a result, an increase in the ink viscosity is suppressed, and the volume of the ink discharged is stabilized.

As described above, according to the embodiment, in the ink jet recording head 21 having a plurality of nozzle arrays 14 that discharge ink of different colors, sub heaters 11 are arranged near the nozzle arrays 14 that discharge ink having high visibility. Therefore, by employing the same number of sub heaters 11 having the same function as in the conventional case, heat insulating effects required to stabilize the volume of ink discharged are efficiently obtained.

Second Embodiment

Figure 7:
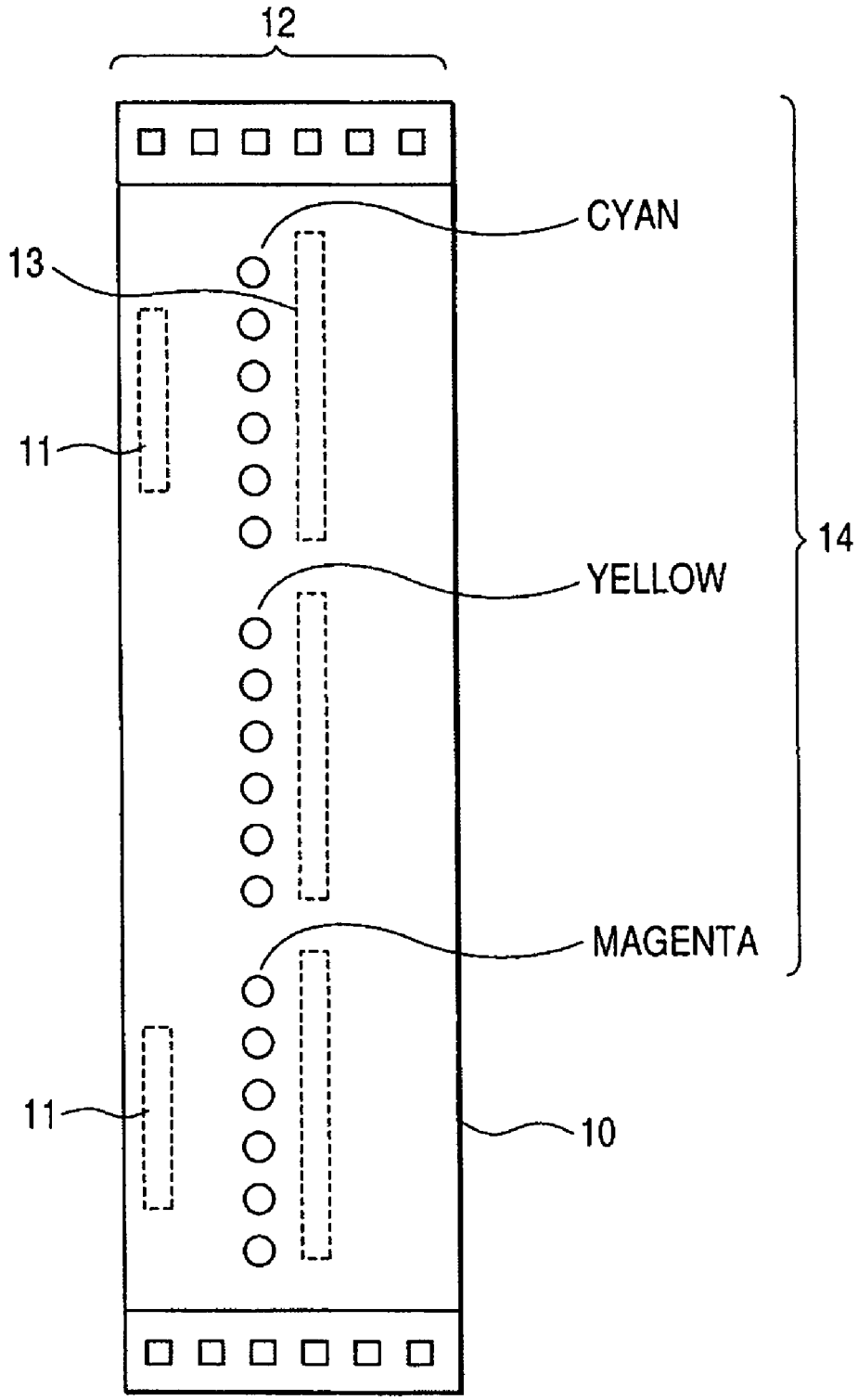
FIG. 7 is a schematic plan view of the structure of a second recording element substrate for an ink jet recording head according to a second embodiment of the present invention.

FIG. 7 is a plan view for explaining the relationships of the nozzle arrays 14 and the sub heaters 11 on a second recording element board 409 for colored ink, according to a second embodiment of the present invention. For portions corresponding to those in the first embodiment, no further explanation will be given.

In this embodiment, three ink supply ports 13 for colored ink, i.e., cyan, magenta and yellow ink, are arranged in series, and electrothermal transducing elements 50 and ink discharge ports 15 are formed to one side of each ink supply port 13. That is, a nozzle array 14 (a set consisting of the electrothermal transducing elements 50 and the ink discharge ports 15) for each ink color is positioned in series.

Specifically, in this embodiment, from one short side to the other short side of the second recording element board 409, the nozzle arrays 14 for discharging cyan, yellow and magenta inks are arranged in series, with the ink supply ports 13 in between. That is, on a whole, one apparent nozzle array is formed on one side of the array of three ink supply ports 13 arranged in series. The apparent nozzle array is formed of three nozzle arrays for different ink colors.

The cyan ink discharge portion and the magenta ink discharge portion are located on the sides (the upper portion and the lower portion in FIG. 7) of the second recording element board 409, and the yellow ink discharge portion is located in the center of the second recording element board 409. In this embodiment, as in the first embodiment, sub heaters 11 are arranged (the upper left and the lower left in FIG. 7) near the nozzle arrays 14 for discharging cyan ink and magenta ink, which have high visibility. Therefore, in this embodiment, heat insulation effects required for stabilization of the volume of ink discharged can also be efficiently obtained. Further, the leading of wiring for electrical connection to the sub heaters 11 can be easily performed.

The present invention is not limited to these two embodiments, and can be applied for any type of ink jet recording head that includes a plurality of nozzle arrays that discharge inks of different colors. Further, the number of ink types used for image forming and the number of nozzle arrays are not especially limited. That is, so long as image forming for a single color is not to be performed, an arbitrary number of ink colors may be employed to perform image forming. A portion for the discharge of ink having a comparatively high visibility must only be located near the outer edge of the board, and in that portion, sub heaters must be located near the nozzle arrays. At this time, ink supply ports should not intervene between the nozzle arrays and the sub heaters, and sub heaters located near the nozzle arrays should be positioned near the outer edge of the board.

In addition, the structure of the recording apparatus is not especially limited, and the present invention can not only be applied for a serial type recording apparatus, but can also be applied for a line type recording apparatus. In such a case, the ink jet recording head is elongated and has a length equal to or exceeding the width of the recordable area of a recording medium, and is fixed to the main body to the recording apparatus.

This application claims priority from Japanese Patent Application No. 2005-040590 filed Feb. 17, 2005, which is hereby incorporated by reference herein.

What is claimed is:

1. An ink jet recording head comprising:

a first nozzle array for discharging yellow ink;

a plurality of second nozzle arrays for discharging cyan ink and magenta ink that have a higher visibility than that of the ink discharged by the first nozzle array; and an element substrate, including a first heat-generating resistor element array and a second heat-generating resistor element arrays, which correspond to the first nozzle array and the second nozzle arrays, and temperature adjustment heaters, wherein one of the temperature adjustment heaters is arranged adjacently to a cyan array of the plurality of second nozzle arrays in a direction perpendicular to the second nozzle arrays and is arranged only in an area between the cyan array of the second nozzle arrays and an end of the element substrate in the perpendicular direction, and another of the temperature adjustment heaters is arranged adjacently to a magenta array of the plurality of second nozzle arrays in the direction perpendicular to the second nozzle arrays and is arranged only in an area between the magenta array of the second nozzle arrays and an end of the element substrate in the perpendicular direction.

2. An ink jet recording head according to claim 1, wherein the element substrate further includes an ink supply port for supplying ink to at least one of the second nozzle arrays, and relative to the ink supply port, the at least one second nozzle array and one of the temperature adjustment heaters are arranged on the same side.

3. An ink jet recording apparatus comprising:

the ink jet recording head recited in claim 1;

a conveyance mechanism for conveying a recording medium;

a carriage for moving the ink jet recording head in a direction intersecting a direction in which the recording medium is conveyed by the conveyance mechanism; and a control portion for employing the temperature adjustment heater to adjust a temperature.

* * * * *